United States Patent [19]

Shinoda et al.

[11] 4,359,663

[45] Nov. 16, 1982

[54] GAS DISCHARGE PANEL HAVING PLURALITY OF SHIFT ELECTRODES

[75] Inventors: Tsutae Shinoda, Akashi; Shizuo Andoh, Kobe; Yoichi Ueda, Hyogoken; Yoshinori Miyashita, Hyogo, all of Japan

[73] Assignee: Fujitsu Limited, Kawasaki, Japan

[21] Appl. No.: 82,320

[22] Filed: Oct. 5, 1979

Related U.S. Application Data

[63] Continuation of Ser. No. 885,962, Mar. 13, 1978, abandoned.

[30] Foreign Application Priority Data

Mar. 11, 1977 [JP] Japan ..... 52-27399

[51] Int. Cl.[3] ..... H01J 17/49; H01J 17/04

[52] U.S. Cl. ..... 313/217

[58] Field of Search ..... 313/217, 220; 315/169.2, 169.4

[56] References Cited

U.S. PATENT DOCUMENTS

| | | | |
|---|---|---|---|
| 3,775,764 | 11/1973 | Gaur . | |
| 3,837,724 | 9/1974 | Haberland et al. | 313/220 X |
| 3,849,686 | 11/1974 | Miyazaki . | |
| 3,919,577 | 11/1975 | Hoehn et al. | 313/220 X |
| 3,944,875 | 3/1976 | Owaki et al. . | |
| 4,027,197 | 5/1977 | Coleman . | |

*Primary Examiner*—Palmer C. Demeo

*Attorney, Agent, or Firm*—Staas & Halsey

[57] ABSTRACT

An AC plasma display panel with a coated thin film dielectric layer on the electrodes has a structure which includes double layers of chromium (Cr) and copper (Cu). After three metal layers of chromium, copper, and chromium are formed on a glass substrate, these three metal layers are subjected to patterning with the desired electrode pattern in such a fashion as to eliminate the upper chromium layer. Then, a thin dielectric film of alumina ($Al_2O_3$) is evaporated onto the two remaining metal layers forming the electrodes. This combination of two layer metal electrodes and dielectric layer is very useful in providing a self-shifting plasma display panel having high quality and reliability.

9 Claims, 10 Drawing Figures

GAS DISCHARGE PANEL HAVING PLURALITY OF SHIFT ELECTRODES

This is a continuation division of application Ser. No. 885,962 filed Mar. 13, 1978, now abandoned.

BACKGROUND OF THE INVENTION

1. Field of the Invention

This invention relates to an improvement of an AC driven gas discharge panel, particularly to a novel combination of electrodes and a dielectric layer in a gas discharge display panel of the self-shifting plasma type.

2. Description of the Prior Art

As an example of a gas discharge panel, an AC driven plasma display panel having a matrix type electrode arrangement is well known. However, such matrix plasma display panels have a drawback, namely, a complicated driving circuit is required in order to address individual discharge cells in the discharge gap at the intersection points of the electrodes arranged transversely in the horizontal and vertical directions on the two substrates. In addition, the cost of such driving circuits drastically increases with an increase in the size of the display panels. Thus, a "self-shifting plasma display" type gas discharge panel providing a discharge spot self shifting function was developed to simplify the driving circuitry.

Examples of such self-shifting plasma display panels providing various kinds of electrode arrangements are described in U.S. Pat. No. 3,944,875, U.S. Pat. No. 3,775,764, U.S. patent application Ser. No. 810,747, filed June 28, 1977, now U.S. Pat. No. 4,185,229 and U.S. patent application Ser. No. 813,627, filed July 7, 1977, now U.S. Pat. No. 4,190,788. The abovenoted U.S. Pat. No. 3,944,875 and both of the abovenoted applications are assigned to the same assignee as that of the present application. Self-shifting type display panels are basically composed of plural groups of shift electrodes connected to plural bus conductors for defining a shift line of discharge cells and write electrodes for defining write discharge cells. However, in such self-shifting plasma display panels, it is essential that only the data input to the write discharge cells be accurately shifted along the shift line. A discharge panel in which the discharge along the shift line is not based on such a data input would be worthless.

When actually operating such a self-shifting plasma display panel, an abnormal discharge occasionally occurs at a position not related to the desired discharge cells. This is not observed in the case of matrix type panels. Such incidental abnormal discharges will disturb the data in the panel, interfering with the display operation. Moreover, if such an abnormal discharge occurs often, the abnormal discharge may break down the dielectric layers, thus seriously reducing the life of the display panel.

The applicants of the present application have considered the various aspects of the abovenoted problem with respect to self-shifting plasma display panels and have determined the cause of such a problem, namely, an incidental abnormal discharge in a display panel results from an undesirable accumulation of charges on the discharge surface. In other words, in an AC driven gas discharge panel of the self-shifting type, a dielectric layer is normally used for coating the electrodes. This layer is generally composed of a glass film having a thickness of about 20 μm and is fabricated by heating, at about 600° C., a low melting point glass powder which has been coated on the electrodes by either printing or spraying techniques. However, in the case of such a dielectric layer formed of a low melting point glass film, bubbles generated by the electrode material during the heating process do not all dissipate completely to the outside of the film. Thus, some bubbles remain in the glass film. In addition, the low melting point glass material itself includes, in some cases, particles which are not melted perfectly and therefore remain in a solid state. Moreover, during the heating process, the low melting point glass material is shaped outwardly at the upper part of electrode, thereby causing the thin film layer to become thinner and, in the extreme, the electrode is exposed. Therefore, the dielectric layer is likely to have substantial differences in its dielectric coefficient as well as other differences in the electrical characteristics due to the abovementioned bubbles, particles and differences in the film thickness. On the other hand, when the abovementioned variations in the electrical film thickness exist along the shift line of a self-shifting type plasma display panel, (on the shift electrodes or between them), the moving charges are unequally accumulated in such areas during the shifting operation. Thus, a difference in the amount of accumulated charges occurs on the display surface, and when the magnitude of such a difference increases due to the repetition of the shifting operation, the abnormal field caused by this accumulated charge, in conjunction with the shift voltage, induces an avalanche phenomenon in the area adjacent to the accumulated charge area. This avalanche phenomenon causes the incidental abnormal misfiring as noted above. If such an accumulation of charges occurs in the thinner part of the dielectric layer, particularly severe discharges may occur. These discharges result in the thermal distortion of the dielectric layer and eventually cause the dielectric layer to break down. Concerning this point, in the case of a matrix type gas discharge panel which allows for only the fixed display of data, unequal accumulation of charges due to the movement of charges does not occur and therefore the aforementioned problem of abnormal discharges does not become important, (even in the case of a dielectric layer consisting of a low melting point glass film). However, in the case of a self-shifting type gas discharge panel, if such abnormal discharges occur even at a single point along the shift line, all the data passing such a point is destroyed, thereby rendering the panel unusable.

SUMMARY OF THE INVENTION

An object of this invention is to provide a self-shifting plasma display panel which has eliminated the abovementioned abnormal discharge drawback.

Another object of this invention is to provide a self-shifting plasma display panel having high quality and reliability.

An additional object of this invention is to provide a high resolution AC driven gas discharge panel having a configuration combining improved electrode arrangement and an improved dielectric layer.

A further object of this invention is to eliminate the inherent structural defect in the conventional dielectric layer which causes the abnormal misfiring in an AC driven gas discharge panel.

Still another object of this invention is to provide an improved process for fabricating an AC driven gas discharge panel having a precise electrode pattern and a high quality dielectric layer.

Briefly stated, taking the viewpoint that the incidental abnormal discharges in conventional self-shifting plasma display panels are due to the structural defects in the dielectric layer coating the electrodes, a panel in accordance with this invention has a dielectric layer composed of a thin evaporated film of an insulating material. As to the choice of material for the thin evaporated film, a metal oxide such as $Al_2O_3$, $SiO_2$, CaO, $La_2O_3$ and $Y_2O_3$ IIA group oxides, rare earth family oxides, insulating nitrides or fluorides such as $MgF_2$, $CaF_2$, etc., various glass materials, as well as a mixture of the above materials can be used. It is also possible to use a colored evaporated film by adding, as required, color generating oxides such as CoO and CuO, etc. Since the dielectric layer formed by evaporating the abovementioned insulating materials comprises a very thin and homogenous film in the form of a solid solution, the incidental abnormal discharges resulting from unequal accumulation of moving charges observed in the existing low melting point glass dielectric layer can be eliminated entirely.

Moreover, this invention provides a gas discharge panel, particularly a self-shifting plasma type display panel, characterized as having a configuration wherein its electrode comprises an underlayer formed on a glass substrate and a conductive layer formed on said underlayer. Said electrode is coated with a thin evaporated film composed of an insulating material. Chromium (Cr) is generally preferable for use as the underlayer material, while copper (Cu) or aluminum Al) is preferable for use as the conductive layer material. An upper layer of chromium (Cr) may be formed on the conductive layer, but this upper chromium layer is eliminated after the patterning of the electrodes in accordance with this invention.

Other objects and salient features of this invention will become apparent from the following embodiments described in connection with the attached drawings.

The embodiment of this invention to be discussed in detail is merely one suitable example of a self-shifting plasma display panel, but it is understood that the invention is not limited to only this one embodiment. It should also be understood that the present invention can be adapted for use in other known AC driven gas discharge panels or plasma display panels.

DESCRIPTION OF THE PREFERRED EMBODIMENTS

Figure 1:
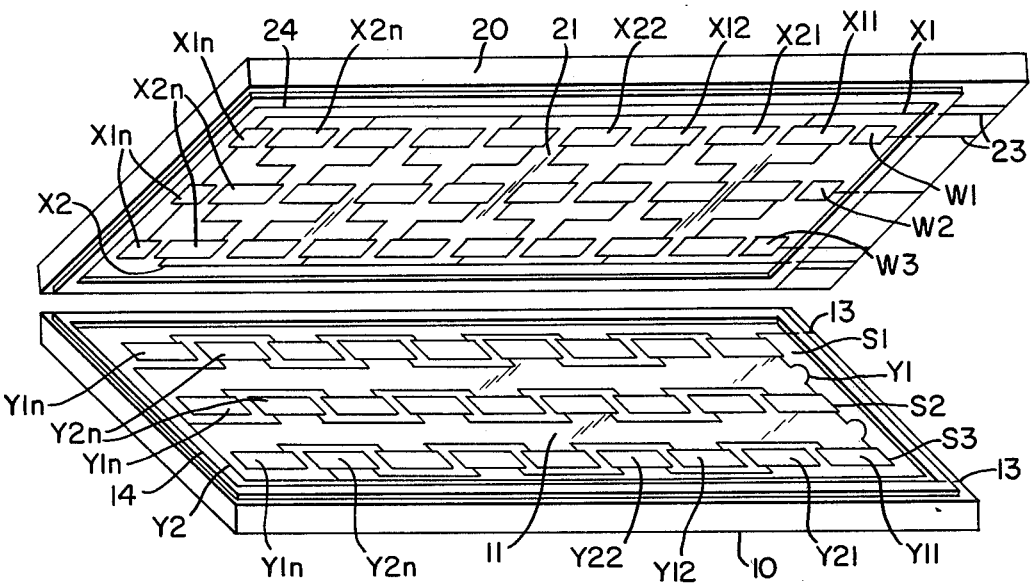
FIG. 1 is a perspective view of a disassembled self-shifting plasma display panel in accordance with one embodiment of the invention.
Figure 2:
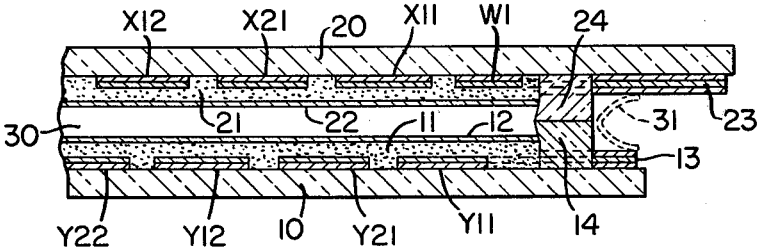
FIG. 2 is a partial cross-section of the panel as shown in FIG. 1.

FIG. 1 shows a perspective view of a partially disassembled embodiment of a self-shifting plasma display panel in accordance with this invention. FIG. 2 is a cross-section of a portion of such a panel. With regard to the panel illustrated in both of these figures, located on the lower glass substrate 10 are first and second electrode groups y11 to y1n and y21 to y2n. These electrode groups are alternately connected in common to a pair of bus conductors Y1 and Y2 along three regularly arranged lines S1, S2 and S3. Located on the upper glass substrate 20 are third and forth electrode groups x11 to x1n and x21 to x2n. These electrode groups are alternately connected in common to a pair of bus conductors X1 and X2 as shown in FIG. 1. Located on the extreme right side of the upper substrate 20 are write electrodes W1 to W3. Write electrodes W1–W3 face the first electrode group y11 located on the extreme right side of the lower substrate 10 and these write electrodes are provided adjacent to the electrode group x11 located on the extreme right side of upper substrate 20. A self-shifting plasma display panel having such an electrode arrangement is disclosed in U.S. patent application Ser. No. 813,627 filed July 7, 1977, and assigned to the same assignee as that of the present application. However, in this invention, the dielectric layers 11 and 21 coating each electrode are formed as an evaporated film consisting of an insulating material. For example, the evaporated films 11 and 21 are each composed of a transparental oxide ($Al_2O_3$) layer which is formed by the electron beam evaporation method and each layer has a thickness of 20 μm or less, (e.g. more preferably about 10 μm). Moreover, overcoat layers 12 and 22 of magnesium oxide (MgO) having a thickness of about 1 μm are evaporated over the surface of said aluminum oxide layer. The MgO overcoat layers 12 and 22 are provided for reducing the discharge voltage by giving a high secondary electron emission ratio to the discharge surface. When the dielectric layers 11 and 21 are themselves composed of an evaporated film of an insulating material such as MgO, CaO and SrO etc., having a high resistivity to ion bombardment due to discharge and a high secondary electron emission ratio, it is not necessary to provide such additional overcoat layers. Thus, the "dielectric layer" as defined in this application should be understood as not necessarily including the abovementioned overcoat layer.

The evaporated film of $Al_2O_3$ forming dielectric layers 11 and 21 and overcoat layers 12 and 22 of MgO are formed having a pattern leaving exposed at least the external connection terminals 13 and 23, (of the bus conductors $Y_1$, $Y_2$, $X_1$, $X_2$), connecting each electrode group and each write electrode $W_1$ to $W_3$. More preferably, the evaporated film is formed on the area inside of the substrate seal. It is recommended that to prevent contamination of the overcoat layers 12 and 22 used as the display surface, the low melting point glass sealant layers 14 and 24 should be coated at the expected sealing portion after the electrode pattern is formed. Such sealant layers are then temporarily heated, followed by the continuous formation of the dielectric layer and overcoat layer. As illustrated in FIG. 2, each electrode coated by its respective dielectric layer 11 and 21, in addition to the conductor used for the interconnections, are given the double layered configuration comprising an underlayer consisting of Chromium and a conductive layer consisting of copper or aluminum. The connecting terminal at 13 and 23, which extend below the low melting point glass sealant layers 14 and 24, are provided with a chromium protection layer formed thereabove so as to prevent oxidization of the copper or aluminum conductive layer. In some cases, the upper surface of an electrode is covered with a thin protection film for preventing oxidization prior to the formation of the evaporated $Al_2O_3$ film comprising the dielectric layers 11 and 21. Such an electrode conductor configuration and its formation process will be explained later in detail. The employment of patterning techniques for the formation of said electrodes utilizing the sputtering method and the photo-etching method (photolithography process) is very convenient for obtaining high resolution and high quality display panels.

A pair of glass substrates 10 and 20, prepared as explained above, are assembled into a configuration as shown in FIG. 2 and then sealed by means of the peripheral low melting point glass sealant layers 14 and 24. The sealing process is carried out at a sealing temperature of about 400° C. Thereafter, the air in the inside gap 30 is exhausted from a not illustrated exhaust tube. The gap 30 is then filled with the desired discharge gas mixture and said exhaust tube is then sealed. In this fashion, a self-shifting type gas discharge panel is fabricated having three lines of shift channels $S_1$ to $S_3$; each channel comprising a periodical arrangement of discharge cells for shifting and an associated write discharge cell.

When each terminal 13 of the bus conductors Y1 and Y2 is bridged to the upper substrate 20 by using the connecting element 31 having a spring action or conductive bonding material, (as shown by a broken line in FIG. 2), then every terminal is arranged in an orderly fashion in the same plane and such an arrangement is very convenient for connection with an external driving circuit. Of course, the upper and lower substrates are reversible.

As is clear from the above explanation, since the dielectric layer for coating the electrode comprises a minute and homogeneous evaporated film in accordance with the invention, the unequal accumulation of charge caused by the shifting of discharge spots and the resultant incidental generation of abnormal discharges, both serious problems in existing panels, can be prevented. Therefore, it becomes possible to fabricate a highly reliable panel with a high manufacturing yield. Moreover, since it also becomes possible to form both the dielectric layer and the overcoat layer used as the display surface by means of a continuous evaporation process having a high yield coefficient, the fabrication period can be drastically reduced, thus contributing to a reduction in the fabrication cost.

Furthermore, in the case of existing dielectric layers consisting of a low melting point glass material, since the dielectric coefficient of the low melting point glass itself is high, and because of the fact that it is difficult to make the thickness of the dielectric layer thinner than 15 μm because of the printing method used and the bubbles that are generated, the capacitance between adjacent electrodes is inevitably large. Therefore, existing dielectric layers are not suitable for obtaining high resolution when considering the coupling between the adjacent cells. However, the application of this invention allows a greater degree of freedom when selecting the materials used and film thicknesses. Therefore, a high resolution panel having a smaller electrode pitch can be easily obtained by forming a thinner film with a material having a low dielectric coefficient such as $Al_2O_3$. With such advantages, load capacitance is also reduced and thereby a panel, (even of large size), can be easily driven. Moreover, brightness is drastically increased since there are no bubbles or particles in the dielectric layers to prevent the permeation of the discharge light. Moreover, in a panel according to this invention, there is little likelihood of any chemical reaction between the electrodes and dielectric layers comprising the evaporated thin film. Therefore, there is virtually no limitation on the electrode materials used and thus a low cost conductive material such as copper or aluminum can be used without requiring the use of intermediate protection materials.

Figure 3:
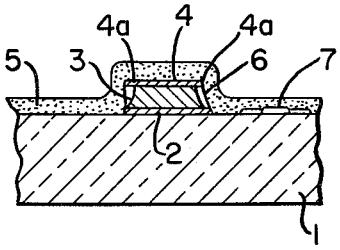
FIG. 3. (PRIOR ART)
FIG. 3 shows, using a model, the generation of a fault on the dielectric layer resulting from the electrode configuration.

The following is a description of the preferred fabrication processes for the abovementioned electrodes and dielectric layers. Electrodes consisting of three layers of Cr-Cu-Cr are employed in the conventional prior art plasma display panels. An electrode obtained by sandwiching a conductive layer of copper with chromium layers from both sides is very convenient for obtaining a low cost and precise electrode pattern and there are no problems in its use as long as it is used in combination with a dielectric layer of low melting point glass cured on the substrate. However, if such a 3-layered electrode is combined with an evaporated thin film dielectric layer as mentioned above, a partial defect can be caused in said dielectric layer. As shown in FIG. 3, the electrode configuration is such that the underlayer 2 is made of Cr, conductive layer 3 is made of Cu, and upper layer 4 is made of Cr to prevent diffusion. These layers are layered on the surface of glass substrate 1 in this sequence. When patterning the Cu layer 3 after etching the upper Cr layer 4 into the specified electrode pattern, the side etching of said Cu layer 3 proceeds simultaneously and thereby the edge 4*a* of the upper Cr layer 4 is projected in the form of an overhang. Thus, when aluminum oxide $Al_2O_3$, for example, is evaporated on the electrode in order to coat the dielectric layer 5, the $Al_2O_3$ is not coated over the area under the edge 4*a* of the Cr layer 4, thereby providing a gap 6. This gap 6 is naturally different in the shape, size and location and therefore exerts an unexpected influence on the gas display panel, more particularly on the discharge characteristics of a self-shifting plasma display panel. Due to this gap 6, the evaporated dielectric layer 5 is peeled out from the substrate at the area around the electrodes, resulting in such inconvenience as the lift off from the substrate as indicated by the reference numeral 7.

Thus, in this invention, such a 2-layer electrode configuration as explained in connection with FIG. 2 is employed in view of eliminating the inconvenience accompanying the abovementioned known process. FIGS. 4 (A) to (G) show partial cross-sections sequentially indicating each step of the process for forming the electrodes and dielectric layers conforming to the preferred embodiment of this invention. These partial cross-sections correspond to the lower substrate in FIG. 2.

Figure 4A:
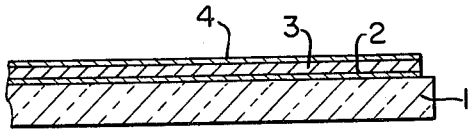
FIGS. 4 (A) to (G) show partial cross-sectional views of the panel of FIG. 1 to illustrate the step-by-step fabrication process used to form the improved electrodes and dielectric layer.

With reference to FIG. 4(A), the first layer 2 of Cr (underlayer), the second layer 3 (conductive layer) and the third layer 4 (upper layer) are formed by either the sputtering method or the evaporation method. The thickness of the first Cr layer 2 is within the range of from 100 to 3000 Å, (for example, 2000 Å). This first underlayer 2 may be fabricated with a material having excellent adhesion to both the glass substrate and the second conductive layer, (e.g.—in addition to Cr, such additional metallic materials as Mn, Ti, Zr or non-metallic materials such as $Al_2O_3$ may be used). The thickness of the second Cu conductive layer 3 is within the range of from 10000 to 30000 Å, (for example, 20000 Å). In addition, the third Cr layer 4 has a thickness within the range of from 100 to 3000 Å, and preferably thinner than the thickness of the first Cr layer, (for example, 1000 Å).

Figure 4B:
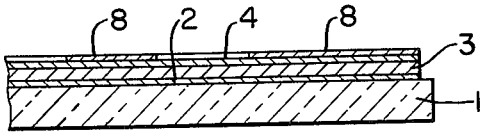

With reference to FIG. 4(B), a photo-resist film 8 is then applied over the abovementioned triple layer of Cr-Cu-Cr and patterning is executed for the pattern including the electrode, connecting conductor, and bus conductor.

Figure 4C:
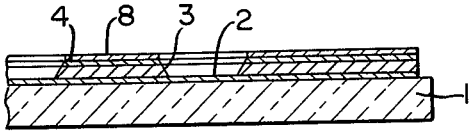

After the patterning of the photoresistive film 8, the unwanted part of the third Cr layer 4 and the second Cu layer 3 is eliminated by a chemical etching method as shown in FIG. 4(C).

Figure 4D:
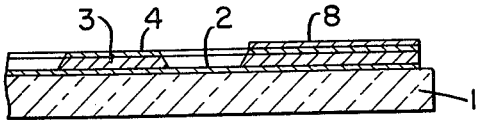

Thereafter, as illustrated in FIG. 4(D), the resist film at the display part is eliminated, leaving the photo resist film 8*a* at the terminal end. Moreover, the remaining area formed by the previous patterning of the third Cr layer 4 in the display part and the unwanted area of the first Cr layer 2 are simultaneously removed by the same chemical etching method.

Figure 4E:
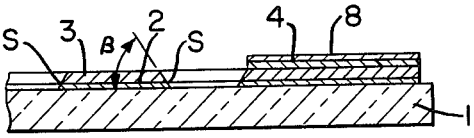

As a result, the electrode arrangement as shown in FIG. 4(E) can be obtained. This arrangement is formed by patterning both the double layer of Cr-Cu at the display part and the triple layer of Cr-Cu-Cr at the terminal end.

Making the third Cr layer 4 thinner than the first Cr layer 2, as explained above, minimizes the side etching of the first Cr layer 2 during the time that these two layers are simultaneously etched. In other words, if the third Cr layer 4 is too thick, the unwanted part of the first Cr layer 2 is first eliminated and thereafter etching proceeds to the lower side of the second Cu layer 3. As a result of this, an unwanted gap may be created under the edge portion of the second Cu layer. Therefore, when the thickness of the first Cr layer 2 is about 2000 Å, it is advisable to make the third Cr layer 4 thinner than the first layer, namely about 1000 Å.

As the etchant for the layer of Cr-Cu-Cr, one can use a mixed aqueous solution of sulfuric acid ($H_2SO_4$) and hydrogen peroxide ($H_2O_2$) of several molar %. When such an etchant is used, as illustrated in FIG. 4(E), the edge portion S of the electrode is etched into the surface with a smooth curve. When the average gradient angle of the electrode edge, expressed by $\beta$, exceeds 60°, it will result in a crevice on the dielectric layer which is to be coated later. However, if this gradient angle $\beta$ is selected to be 60° or less (or more preferably, to about 45°), a crevice may not be generated. The gradient angle $\beta$ can be controlled in accordance with the composition of the etchant. In the case of an etchant utilizing the abovementioned $H_2SO_4$ and $H_2O_2$, the average gradient angle $\beta$ tends to increase when the concentration of $H_2O_2$ becomes high.

Figure 4F:
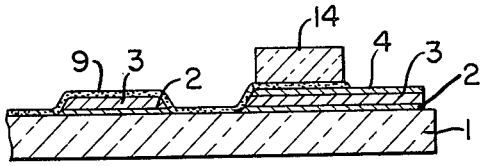

On the other hand, as explained above, the electrodes which are formed by patterning are then coated with a dielectric layer. In such case, as shown in FIG. 4(F), the electrode surface is first coated by a thinner film. For example, a protection film 9 of $Al_2O_3$ is evaporated with a thickness of 1 to 2 $\mu$m and a sealant 14 of low melting point glass is formed by the printing method at the expected sealing area. For the evaporated protection film 9, an insulating oxide such as $La_2O_3$, MgO, $TiO_2$, $ZrO_2$ and $SiO_2$ etc., may be used instead of $Al_2O_3$. The protection film contributes to the prevention of oxidization of the electrode surface during the time when said sealant 14 is subjected to the heating process for prebaking. The electrode protection film 9 should be formed in such a fashion as to completely cover at least the electrode surface of the display part where the second Cu layer 3 is exposed. However, it may be formed in such a manner as to also cover the edge portion having the triple layer configuration of Cr-Cu-Cr. The protection film coated on such an edge portion will be, of course, removed after completion of the panel. It is very convenient to apply and pre-bake the sealing material before forming the complete dielectric layer in order to obtain sufficient sealing strength and to minimize the contamination of the dielectric layer surface. Moreover, if Al is used as the conductive layer of the electrode, (instead of Cu), it has been observed that a thermal hillack due to recrystallization grows on the surface of the Al during the heating process for the pre-baking of the sealing material. Such a hillack impairs the quality of the dielectric layer to be formed later. However, by forming the abovementioned protection film of $Al_2O_3$, the generation of such a thermal hillack can be suppressed.

Figure 4G:
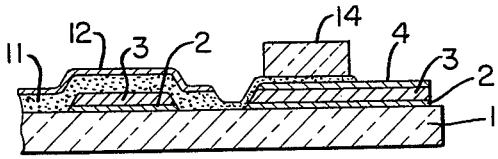

After completing the formation and processing of the seal material 14, the $Al_2O_3$ used to fabricate the dielectric layer is vacuum evaporated with a thickness of about 10 $\mu$m on the inside area of said seal material, namely, on the protection film 9 at the display portion. Moreover, the MgO overcoat layer 12 is also vacuum evaporated thereon with a thickness of about 1 $\mu$m. Thus, as shown in FIG. 4(G), a substrate assembly supporting electrodes coated by a dielectric layer can be completed.

The above explanation is given with respect to one embodiment of this invention and it goes without saying that various modifications are possible. For example, a gas discharge panel having a cross-electrode configuration or a parallel electrode configuration, and or a self-shifting plasma display panel of the surface discharge type having the electrodes used for shifting located on one substrate surface, are already well known and such additional panel types may be fabricated in accordance with the present invention in the same fashion as the gas discharge panel having the meander electrode arrangement as shown in FIG. 1. It is therefore possible to obtain the same advantages with these other types of display panels as that of the meander electrode type panel by providing similar layering configurations. Moreover, as the evaporated film material used for the dielectric layer, $Al_2O_3$ is an excellent choice of materials because it can be obtained easily, it does not easily form crevices during processing, it has excellent transparency, and it has excellent electrical characteristics. However, a single material or mixture of several materials selected as desired from other insulating metal oxides, nitrides, oxides or fluorides of IIA group elements, oxides or rare earth elements, and various glass materials can be used. The formed "evaporated film" or layer in this case can include various kinds of films obtained by the sputtering method and selected in accordance with the source material, films obtained by the chemical evaporation method, and those films which may be obtained by the electron beam evaporation method. The thickness of said evaporated film can be freely controlled within the range from 1 to 50 $\mu$m. Furthermore, the film configuration is not limited to a single layer. In the case of a panel having high resolution, as shown in FIG. 1, it is preferable to form the film with a material such as $Al_2O_3$ having a low dielectric coefficient and a thickness of 10 $\mu$m or less.

As an additional embodiment, in a display panel configuration as shown in FIG. 1, the display contrast can be improved by preferably coloring black the evaporated film dielectric layer 11 formed on the lower substrate. Such a colored dielectric layer can be formed by fabricating the evaporated film using a material to which a color generating oxide such as CuO and CoO, etc., has been added or by using such a color generating oxide by itself, or by fabricating the dielectric layer in the form of a complex multilayer film wherein thinner colored evaporated films are layered into a transparent evaporated film. In the latter case, the problem occuring when colored materials form particles in the dielectric layer is avoided entirely.

According to this invention, the problem discussed above as particularly arising in self-shifting type gas discharge panels resulting from structural defects in the dielectric layer can be very effectively eliminated. Similar improvements can also be attained by adapting this invention to various other known AC driven type gas discharge panels.

We claim:

1. A self-shifting sealed discharge panel having a gas discharge space containing an ionizable gas and a plurality of shift electrodes having edges, said panel comprising:

a dielectric layer;

a pair of insulating substrates spaced apart from each other for supporting said plurality of shift electrodes, said plurality of shift electrodes being coated with said dielectric layer at least on one of said pairs of insulating substrates, the edges of said shift electrodes as covered by said dielectric layer having a maximum average gradient angle of 60°;

a plurality of bus conductors on each said substrate, each said plurality of shift electrodes on each said substrate being connected regularly to the respective plurality of bus conductors on the same substrate, and said shift electrodes on both said substrates being positioned face to face across said gas discharge space;

each of said plurality of shift electrodes comprising a portion which is located within said gas discharge space and at least on one of said substrates having a double layer structure comprising an underlayer directly formed on the respectively insulating substrate and a conductive metal layer formed on said underlayer;

at least one of said plurality of shift electrodes further comprising a terminal portion which is located outside of said gas discharge space and comprises an additional metal layer formed on said conductive metal layer;

said dielectric layer comprising an evaporated film of insulating material.

2. The panel of claim 1, wherein said underlayer is comprised of chromium, said conductive layer is comprised of copper, and said dielectric layer is comprised of an evaporated film of aluminum oxide.

3. The panel of claim 1, wherein said plurality of shift electrodes are ribbon shaped.

4. A substrate assembly for an AC driven gas discharge panel comprising:

a glass substrate having a flat surface;

an electrode arrangement formed on the surface of said glass substrate with a specified electrode pattern;

a dielectric layer coated on said electrode arrangement; and each electrode of said electrode arrangement having edges and comprising a double layer structure comprising a first layer formed on said glass substrate and a second layer which is conductive and formed on said first layer, wherein said dielectric layer is evaporated directly onto said second layer;

said electrode arrangement further comprising a terminal portion which comprises an additional conductive layer formed on said second layer; and the edges of said electrodes of said electrode arrangement and said dielectric layer coated thereon having a maximum average gradient angle of 60° with respect to the glass substrate surface.

5. The assembly of claim 4, wherein said plurality of electrodes are ribbon shaped and said first layer of said electrode arrangement is comprised of chromium and the second layer of said electrode arrangement is comprised of copper.

6. In a self-shifting sealed discharge panel having a gas discharge space containing an ionizable gas and a plurality of shift electrodes comprising a dielectric layer, a pair of insulating substrates spaced apart from each other for supporting said plurality of shift electrodes, said plurality of shift electrodes having edges and being coated with said dielectric layer on at least one of said pairs of insulating substrates, a plurality of bus conductors, said plurality of shift electrodes being connected regularly to said plurality of bus conductors and positioned face to face across said gas discharge space, the improvement comprising:

each of said plurality of shift electrodes comprising a portion which is located within said gas discharge space and having a double layer structure comprising an underlayer directly formed on the respective substrate and a conductive metal layer formed on said underlayer, said dielectric layer comprising an evaporated film of insulating material covering the edge of each said double layer structure electrode so that the edge of said covered electrode has a maximum average gradient angle at 60°;

at least one of said plurality of shift electrodes further comprising a terminal portion which is located outside said gas discharge space and comprises an additional metal layer formed on said conductive layer.

7. The panel of claim 6, wherein said plurality of shift electrodes are ribbon shaped.

8. In a substrate assembly for a gas discharge panel comprising a glass substrate, an electrode arrangement of electrodes having edges formed on said glass substrate, said electrode arrangement having a specified electrode pattern, the improvement comprising:

a dielectric layer coated on said electrode arrangement, said electrode arrangement comprising a double layer structure comprising a first layer formed on said glass substrate and a second layer which is conductive and formed on said first layer, wherein said dielectric layer is uniform as a result of being evaporated on said second layer, and the edge of each said electrode of said electrode arrangement as covered by said dielectric layer having a maximum average gradient angle of 60° with respect to the surface of the respective substrate on which it is formed; and said electrode arrangement further comprising a terminal portion which comprises an additional conductive layer formed on said second layer.

9. The assembly of claim 8, wherein said first layer of said electrode arrangement is comprised of chromium and the second layer of said electrode arrangement is comprised of copper, and wherein said electrode arrangement comprises ribbon shaped portions.

* * * * *

UNITED STATES PATENT AND TRADEMARK OFFICE

CERTIFICATE OF CORRECTION

PATENT NO. : 4,359,663

DATED : 16 November 1982

INVENTOR(S) : SHINODA, et al

It is certified that error appears in the above-identified patent and that said Letters Patent is hereby corrected as shown below:

Column 3, line 32, "Al)" should be --(Al)--.

Column 4, line 25, "transparental" should be --transparent aluminum--.

Column 8, line 11, "hillack" should be --hillock--;

line 13, "hillack" should be --hillock--;

line 17, "hillack" should be --hillock--;

line 32, delete "or" (second occurrence).

Signed and Sealed this

*Fifth* Day of *April 1983*

[SEAL]

*Attest:*

GERALD J. MOSSINGHOFF

*Attesting Officer*

*Commissioner of Patents and Trademarks*